US009301564B2

(12) United States Patent
Roeckelein

(10) Patent No.: US 9,301,564 B2
(45) Date of Patent: Apr. 5, 2016

(54) MAGNETIC GARMENT WEAR AND ATTACHMENTS FOR APPAREL

(71) Applicant: Gabrielle Roeckelein, Chandler, AZ (US)

(72) Inventor: Gabrielle Roeckelein, Chandler, AZ (US)

( * ) Notice: Subject to any disclaimer, the term of this patent is extended or adjusted under 35 U.S.C. 154(b) by 0 days.

(21) Appl. No.: 14/485,996

(22) Filed: Sep. 15, 2014

(65) Prior Publication Data

US 2015/0033452 A1 Feb. 5, 2015

(51) Int. Cl.

| | |
|---|---|
| ***A41D 23/00*** | (2006.01) |
| ***A41D 27/08*** | (2006.01) |
| ***A41D 27/18*** | (2006.01) |

(52) U.S. Cl.

CPC ..... *A41D 27/08* (2013.01); *A41D 23/00* (2013.01); *A41D 27/18* (2013.01)

(58) Field of Classification Search

CPC ..... A41D 27/08; A41D 23/00; A41D 27/18
USPC ..... 2/257, 98, 100, 101, 116, 130, 137, 139
See application file for complete search history.

(56) References Cited

U.S. PATENT DOCUMENTS

| | | | | | |
|---|---|---|---|---|---|
| 2,601,424 | A * | 6/1952 | Baker | 24/66.1 |
| 2,616,088 | A * | 11/1952 | Sharkey | 2/152.1 |
| 3,102,314 | A * | 9/1963 | Alderfer | 24/303 |
| 3,128,470 | A * | 4/1964 | Petermann et al. | 2/145 |
| 3,161,932 | A * | 12/1964 | Russell | 24/303 |
| 3,261,025 | A * | 7/1966 | Simek | 2/149 |
| 3,538,510 | A * | 11/1970 | Davis, Sr. | 2/152.1 |
| 3,733,614 | A * | 5/1973 | Abramowitz | 2/144 |
| 4,286,337 | A * | 9/1981 | Malouf, Jr. | 2/116 |
| 5,682,653 | A * | 11/1997 | Berglof et al. | 24/303 |
| 5,974,634 | A * | 11/1999 | Eisenpresser | 24/303 |
| 6,089,422 | A * | 7/2000 | Gibson | 223/84 |
| 6,216,275 | B1 * | 4/2001 | Lee | 2/144 |
| 6,434,801 | B2 * | 8/2002 | Grunberger | 24/303 |
| 6,748,602 | B1 * | 6/2004 | Barnes | 2/132 |
| 7,373,696 | B2 * | 5/2008 | Schoening et al. | 24/66.1 |
| 7,409,730 | B2 * | 8/2008 | Boos | 2/132 |
| 7,770,236 | B2 * | 8/2010 | Gulisano | 2/98 |
| 8,813,264 | B2 * | 8/2014 | Boos | 2/132 |
| 2008/0092268 | A1 * | 4/2008 | Mangham | 2/129 |
| 2008/0276347 | A1 * | 11/2008 | Alfin | 2/137 |
| 2011/0219516 | A1 * | 9/2011 | Pionessa | 2/145 |
| 2011/0289650 | A1 * | 12/2011 | Arrona | 2/129 |
| 2013/0269083 | A1 * | 10/2013 | Paglione | 2/145 |
| 2014/0101819 | A1 * | 4/2014 | Ike | 2/145 |
| 2014/0366242 | A1 * | 12/2014 | Pulsifer | 2/139 |

* cited by examiner

*Primary Examiner* — Danny Worrell

(57) ABSTRACT

This invention relates to the method, apparatus and garment technique for attaching neckwear apparel together with magnets at the collar area while leaving the top shirt button unbuttoned. The invention will feature pieces of fabric portions to make up a whole garment. There are many origami folding techniques and shown will not be limited to the single example illustrated but encompass all origami sculptural combinations of fabrics and other materials that are made from both natural and synthetic fibers. For purposes of this invention, shown will be a typical garment made from fabric and will be cut into 8"×8" portioned squares or 13"×13" squares for the larger garment styles. The portions will be bound together, and have between a 5 to 15 folding step processes to make the ornamental garment piece. All the sculptural forms and magnetic attachments created are the invention as a whole.

1 Claim, 20 Drawing Sheets

MAGNETIC GARMENT WEAR AND ATTACHMENTS FOR APPAREL

BACKGROUND OF THE INVENTION

The classic wrap around the neck and knot configuration in the front at the collar garment, such as a regular necktie, has needed a new design for years. Common neckwear garments for women are scarves; men to date are neckties, lanyards and bowties. Regular neckties and bowties are uncomfortable, binding and hot. The inability for a person to have a collared shirt and be unbuttoned is an ongoing issue. The wearer tends to loosen the garment and unbutton, move the tie off to one side and or remove it as soon as they are not inhibited by the environment. Thus, magnet garment wear invention and is presented herewith in.

The magnetic garment wear can be interchangeable with various shirt styles and colors dependent on the wearer's preference. The magnetic garment wear will be of an origami technique. The term origami is defined from or meaning "folding", and kami meaning "paper" and is the traditional Japanese art of paper folding, which started in the 17th century AD. The goal of origami is to transform a flat sheet of paper into a finished sculpture through folding and sculpting techniques. The number of basic origami folds is small, but they can be combined in a variety of ways to make intricate designs and sculptural forms.

The desirability of having a magnetic devise hidden from view and adjustable to allow the wearer to open the top shirt button and still retain its original styling is needed. The desirability of the invention does not damage the apparel by piercing as other inventors have deemed. The invention adjusts to the wearer of collared shirts and blouses that have otherwise become uncomfortable due to shrinkage through regular washing and dry cleaning. By unbuttoning a top button or sliding the magnet coupling to another hold area, the invention has flexibility and promotes air circulation.

The basic anatomy of a shirt collar is a combination of sections bound together that form what is known as a collar leaf seen from the outside view, the collar base to which the leaf is attached under the collar leaf. Another area is called the span area which is at the front of the collar and is the distance between the two collar points when buttoned.

The invention includes magnets, which can be for instance, but not limited to (2) two sets of neodymium magnets of Grade N42 or better together in the garment combination. Neodymium magnets are a member of the Rare Earth magnet family and are the most powerful permanent magnets in the world. They are also referred to as NdFeB magnets, or NIB, because they are composed mainly of Neodymium (Nd), Iron (Fe) and Boron (B). Magnets typically attach to Iron to make a coupling. They are a relatively new invention and have only recently become affordable for everyday use. The magnets in the invention are coated so they will not rust, nor damage fabrics in a regular dry clean only scenario, but by no means are claimed to stand through constant regular washings from the typical household washing and drying appliances. Magnets lose strength if they are heated above their maximum operating temperature, which is 176° F. (80° C.) for standard N grades.

Many magnetic solutions have been attempted as seen in the magnetic devices that have recently been in the apparel marketplace through U.S. Pat. No. 6,434,801 B2 to Erico Grunberger; U.S. Pat. No. 2,397,931 issued to Ellis for the button disclosed; the magnetic button U.S. Pat. No. 5,974,634 issued by Eisenpresser and magnetic attaching devise U.S. Pat. No. 5,732,451 issued to Mars; U.S. Pat. No. 2,601,424 issued to Baker; U.S. Pat. No. 6,216,275 B1 issues to Lee have securing devises, but not garment design, function and comfort. Also, U.S. Pat. No. 7,373,696 B2 issued to Brian Schoening, Stephen Dorgan, Micheal R Capesius and Szymon Latawiee had proposed magnetic ties to attach to the surface of the shirt at the button area, but not the collar area as will be described herein. Barns U.S. Pat. No. 6,748,602 attempted to have a two piece magnetic coupling, but it was visible, and heavy. Johnathan Boos, U.S. Pat. No. 8,108,948 invented a collar stay, but not a garment. This garment invention includes techniques that are origami folded in technique and are by no means are wrapped around the neck and knotted as a regular necktie would be attached.

BRIEF SUMMARY OF INVENTION

What is disclosed is a method, apparatus and garment invention to solve an issue for people who have the option of unbuttoning a shirt collar and magnetically attach the apparatus underneath a collar at the collar base and inside a shirt or blouse collar leaf which overcomes one or more of the shortcomings discussed above. The invention has multiple portions which make up the whole and is not limited to the one illustrated origami technique, but does include all fabric origami folding techniques made from natural or synthetic fibers bound together whether square, circular or the like shapes used to make a neckwear garment.

DETAILED DESCRIPTION

A preferred aspect of the invention is a strong magnetic coupling consisting of garment portions made from a variety of fabrics and folded together. The magnets are a part of this garment, usually sewn in, but may be glued, heat sealed or the like.

The first portion of the invention is the garment itself which are fabrics derived from silk, satin, linen, velvet, polyester, rayon, wool and other combinations of natural and synthetic fibers. The fabric will be cut into 8"×8" portioned squares (or other shaped fabrics) or 13"×13" squares for the larger garment styles for the illustration purposes but limited to only the above dimensions. The portions will then be bound together, usually between a 5-12 folding step processes, and then ironed, to make into sculptural forms to be the first decorative portion of the garment.

A second portion of the garment which finishes at 7" W×1" H rectangular shaped band will encase a magnet(s) at the two ends which are sewn, glued or the like. These two garment pieces will be bound together to make the garment and be the first coupling of the magnetic coupling pieces in the technique to follow. Some garments will have the magnets encased at the time of manufacture at strategic points and will not need an additional rectangular band piece. The garment style of various origami techniques allows the manufacturer to attach the magnets before the entire garment square is completely bound, folded and sealed.

The third portion of the coupling will be magnets sewn, glued or the like encased in two (2) ¾"×¾"+/−¼" pouches or tabs which will be made from the above fabrics of either natural or synthetic fibers. These pouches or tabs will ultimately fit inside the shirt collar at the collar base.

The pouches or tabs magnetic garment pieces are positioned by the wearer at the inside surface at the collar base, and the garment piece outside the collar leaf will have encased the magnetic coupling too. The garment coupling has significant magnetic force to attract and hold both garment pieces in place and allow the wearer to adjust to a desired position and orientation. If the wearer needs to adjust the garment coupling, the wearer can grasp the outside of the garment accessory under the collar leaf and gently pull forwards or backwards along the collar base line. Once the person wearing the garment has reached their desired garment position, the wearer can move freely around and have the garment and apparatus remain stable. The magnet will have a disc, round, conical, sphere shape or preferred, rectangular shape, and be approximately ¾"×¼"×1/16"+/−¾". The magnets will be concealed both inside the shirt and under the collar leaf encased inside the fabric pouches and slots and still provide an adequate magnetic force to hold the garment at its desired position.

The preferred overall garment ranges in styles and shapes which vary from sizes of 4"-7" W×9"-12" L+/−0.1"; 7½" W×4" L+/−½" and not limited to these dimensions. As to thickness, a suitable value is ¼"-¾". A suitable protrusion height from the front of the garment to the back is ¼"-½".

The following steps are used with shirts featuring any collar style:

1. Place one magnetic filled pouch/tab inside the collar base at the neck and hold in place preferable with the index finger and thumb on one side of the shirt collar base.
2. Then, position the garment accessory piece under the collar leaf with the thumb and forefinger; the two pieces will attach using the magnetic attraction properties; and
3. Repeat steps 1 and 2 on the other side of the collar.
4. To center or straighten to a desired position, lift collar leaf and gently pull the outer garment forwards or backwards and place as desired; the inside pouches or tabs will follow the movement and stay magnetically adhered.

BRIEF DESCRIPTION OF THE DRAWINGS

FIG. 5 illustrates for the purposes of the invention and is not limited to square fabric parts but can be materials that are circular and angular in nature. Also, if there is a material that can be viewed from both sides called "double-sided", the fabric need only be surged on the perimeter of the material to prevent fraying.

The dashed lines depict the hidden area under Piece 21 that can be sewn, glued or the like.

DETAILED DESCRIPTION OF THE DRAWINGS

This invention is subject to many different forms and shapes and the preferred method shown illustrations have certain details with the understanding that the present disclosure should be considered as an example of the basic principles of the garment invention and it is not intended to limit to the variations of folding origami techniques to any other sizes, colors and materials but will be the basic concept of the invention.

Figure 1:
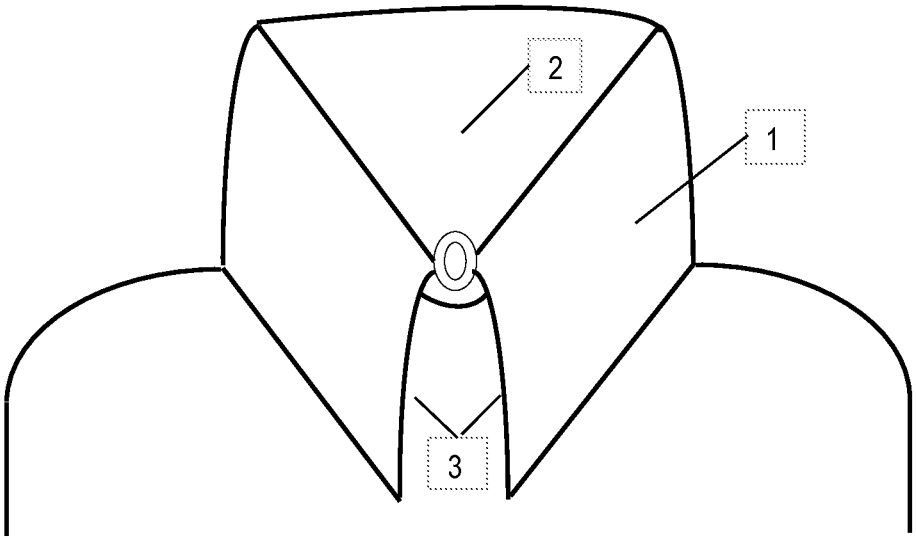
FIG. 1: 1 depicts anatomy of shirt at outside viewed typical collar leaf of buttoned dress shirt 2 is the open neck area 3 is the frontal area of shirt called the shirt span with top button closed as illustrated.

Referring now to the drawings, wherein like numerals refer to like parts particularly FIG. 1 illustrates a typical shirt buttoned at the top for showing where the invention will be utilized. 1 illustrates the outside collar leaf of a typical shirt with a button closure at the neck area 2 illustrate the open area for the neck 3 illustrate the front collar spread of a shirt with top button closed.

Figure 2:
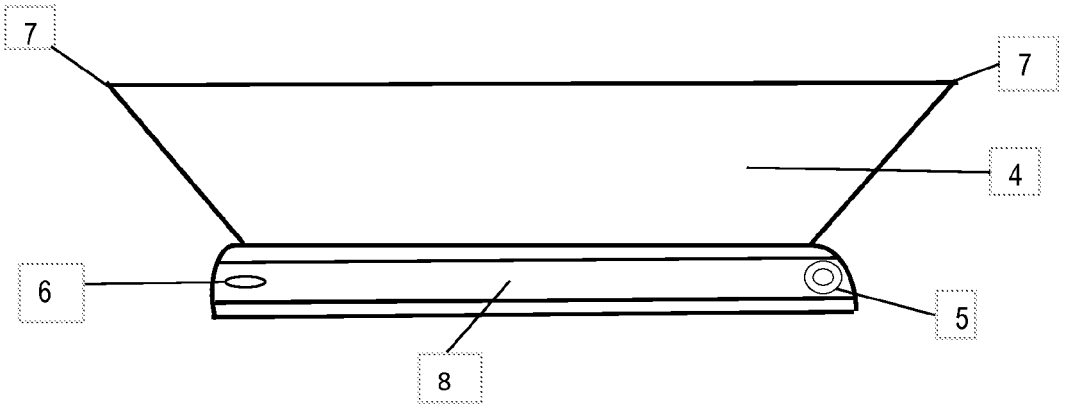
FIG. 2: 4 depicts inside of shirt collar leaf 5 is a button and 6 is the button hole 7 is the tip of a collar leaf 8 is the collar base.
Figure 4:
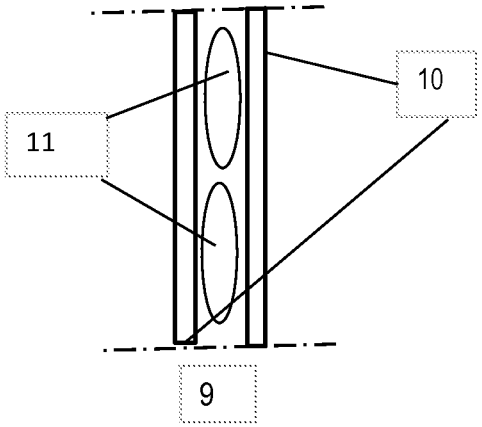
FIG. 4: 9 depicts a cross section of magnet pockets Piece 22 at the ends. 10 is the fabric and 11 are the magnets that will be encased; two magnets for this example are illustrated. The dot and dashed line indicates the cross section cut.

FIG. 2 4 illustrates the inside of shirt collar leaf 5 is a button and 6 is the button hole 7 is the front tip of a collar leaf 8 is the collar base and is the inside area where the invention will be placed which shows no hindrance for the invention.

Figure 3:
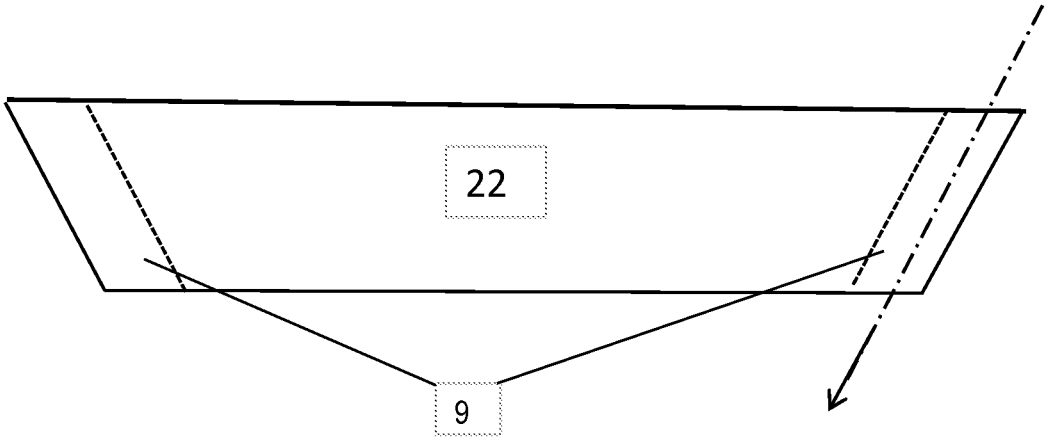
FIG. 3: depicts the first garment portion which is the rectangular band and is called Piece 22; 9 is the area that will have 1 to 3 magnets encased inside fabric pocket or slot per Piece 22 at each ends as illustrated. This Piece 22 will encompass the first portion of the garment coupling of the magnetic attachments to the outside area at the collar leaf. The dot and dashed arrows indicates the cross section cut that will be defined in FIG. 4 below.

FIG. 3: illustrates the portion which is a rectangular shape invention named Piece 22 that is made of natural or synthetic fibers and encases neodymium magnet(s) of N42 or stronger in each end. The N42 specifications for illustrative purposes are as follows:

Tolerances: ±0.004"×±0.004"×±0.004"; Material: NdFeB, Grade N42; Plating/Coating: Ni—Cu—Ni (Nickel); Magnetization Direction: Thru Thickness; Weight: 0.0508 oz. (1.44 g), Pull Force, Case 1: 3.07 lbs; Pull Force, Case 2: 13.51 lbs; Surface Field: 2060 Gauss; Max Operating Temp: 176° F. (80° C.); Brmax: 13,200 Gauss; BHmax: 42 MGOe. Sourcing for this data was derived from K & J Magnets.

For the garment illustration, the rectangular garment piece is approximately 7" W×1" H+/−½" D and is sewn, glued, or the like, sealed so the magnet cannot escape as is seen by the dashed line 9 where the sew area located. The fabric can be made of a variety of fabrics that have natural and synthetic fibers such as linen, wool, silk, rayon, polyester and the like as illustrated in Piece 22. 9 is the area that will have 1 to 3 (but not limited to 3 quantity) magnets encased inside fabric pocket or slot per Piece 22 at each ends as illustrated. This Piece 22 will encompass the first portion of the coupling of the magnetic attachment of magnets to a shirt. The dot and dashed arrow indicates a cross section cut for FIG. 4 below.

FIG. 4: is the illustrated cross section of the area 9 at either end for the illustration 10 is the fabrics 11 are the magnet(s). The dot and dashed line indicates the cross section cut.

Figure 5:
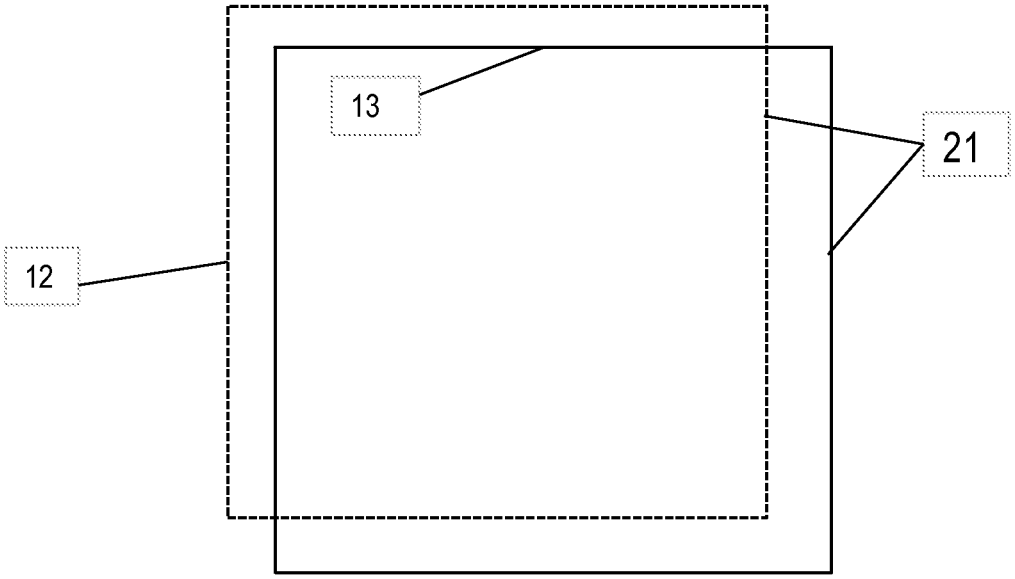
FIG. 5: depicts the whole Piece 21 at the starting point. Piece 21 is (2) two pieces of fabric cut into (2) two squares 12 being the backside shown by a dashed line and 13 sizes either 8"×8" or 13"×13", bound together.

FIG. 5: illustrates two squares of fabric both 8"×8" sized squares or 13"×13" sized squares, and then bound together 12 and 13 to form Piece 21. The illustration shows dashed line 12 which would be the back side of the square before it's bound together by sewing, gluing or the like to 13 the front side of another piece of fabric or material. These fabrics can be either natural or synthetic fibers. These combined squares of fabric are bound together and then ironed to create an origami sculpture technique as will be illustrated below in FIG. 8 through FIG. 13. There can be between 5 to 12 folds in each garment shape at the final result. These final garment shapes vary in size from 7" W×12 L"+/−½" D; 7½" W×5¼" L+/−½" D. In some cases, there are options of what is known as "double-sided" fabric which is the nature of being ornamental on both sides of the front and back. If this type of fabric or material is used, only surging and sealing the ends are necessary to prevent fraying. An example of this fabric would be a double-sided taffeta made from 100% silk.

Figure 6:
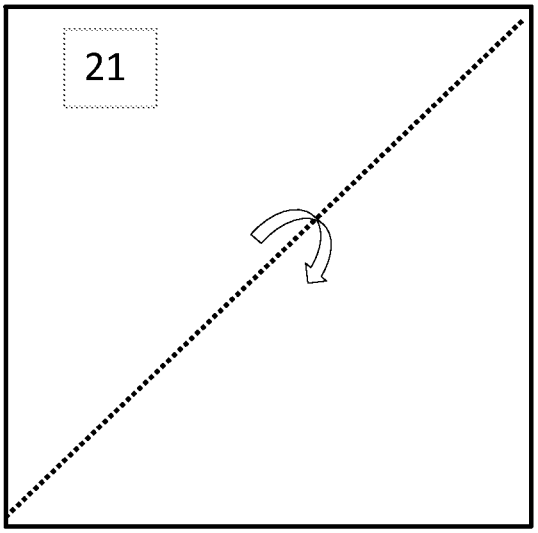
FIG. 6: depicts a double layer of fabrics that have been turned inside out and pressed. The dotted line indicates where Piece 21 will be folded in half to make a triangle shape.

FIG. 6: illustrates Piece 21 turned inside out and pressed. The beginning of the origami technique begins here and the dotted lines where Piece 21 will be folded in half into a triangular shape. The arrow will indicate the direction of the fold.

Figure 7:
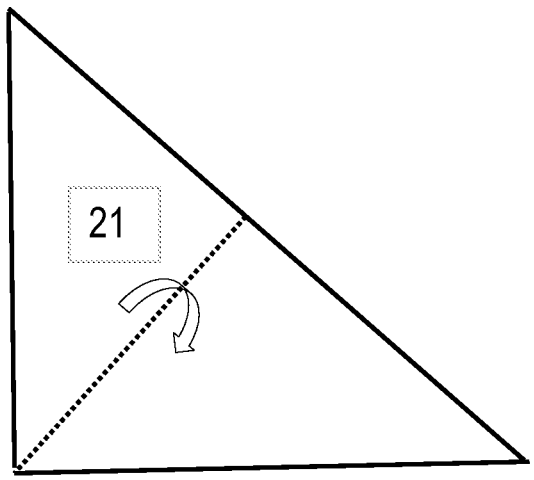
FIG. 7: depicts the Piece 21 folded to make another triangular shape. The dotted line shows the fold area. The arrow indicates the direction of the fold.

FIG. 7: illustrates the Piece 21 folded and the dotted line shows the fold area. The arrow indicates the direction of the fold. Piece 21 is then unfolded and the dotted line becomes a center guideline for upcoming folding procedures below.

Figure 8:
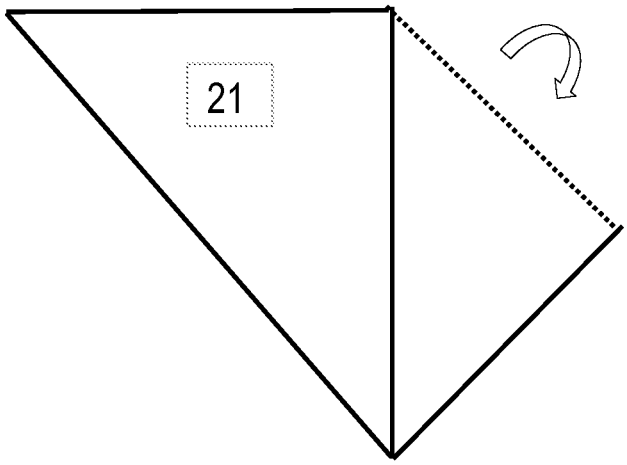
FIG. 8: depicts the top right corner folded down of Piece 21 with the tip folded at the bottom on the center line. The dotted line shows the fold area and the arrow shows the direction of the fold.

FIG. 8: illustrates the top right corner tip is folded downward resulting in a new triangle at the center guideline of Piece 21. The dotted line illustrates the fold line. The arrow indicates the direction of the fold.

Figure 9:
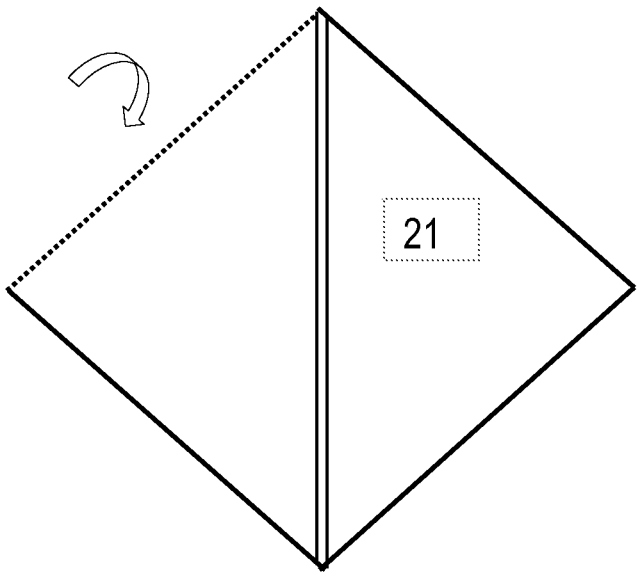
FIG. 9: depicts the fold of the left corner forming a diamond shape of folded piece 21. The arrow shows the direction of the fold.

FIG. 9: illustrates the left corner of Piece 21 folded to the center guideline and then forms a diamond shape as a whole. The dotted line illustrates the fold line. The arrow indicates the direction of the fold.

Figure 10:
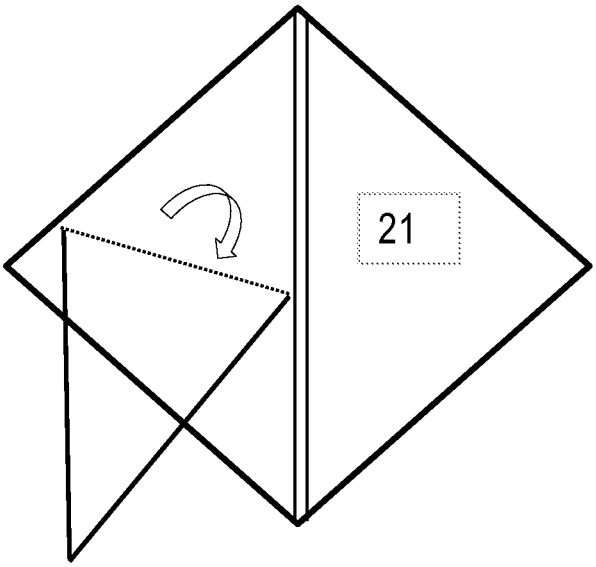
FIG. 10: depicts the top left corner folded down on Piece 21 approximately 99 to 102 degree angle. The dotted line shows the fold area and the arrow shows the direction of the fold.

FIG. 10: illustrates Piece 21 now will be turned at a 180 angle to continue the origami technique. The top left corner is folded down and towards the front at an approximately a 99 to 102 degree angle on Piece 21. The dotted line is the fold area. The arrow indicates the direction of the fold.

Figure 11:
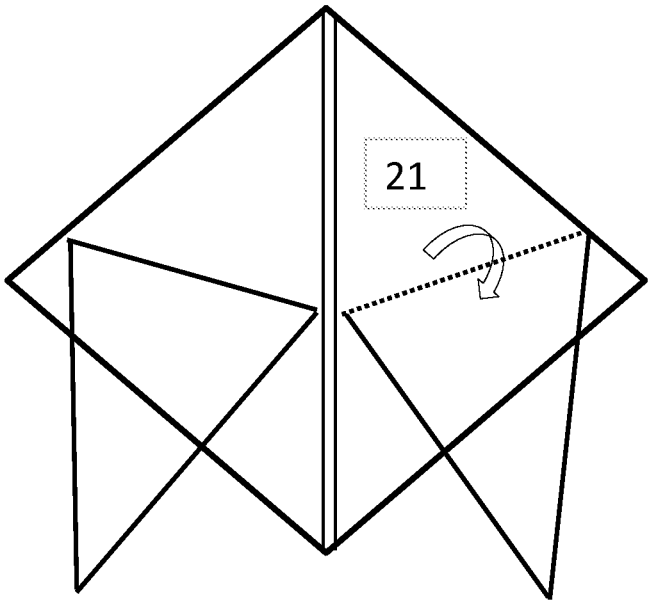
FIG. 11 depicts right corner folded down on Piece 21. The dotted line shows the folded areas and the arrow shows the direction of the fold.

FIG. 11 illustrates the top right corner folded down approximately 99 to 102 degree angle on Piece 21. The dotted lines are the folded areas. The arrow indicates the direction of the fold.

Figure 12:
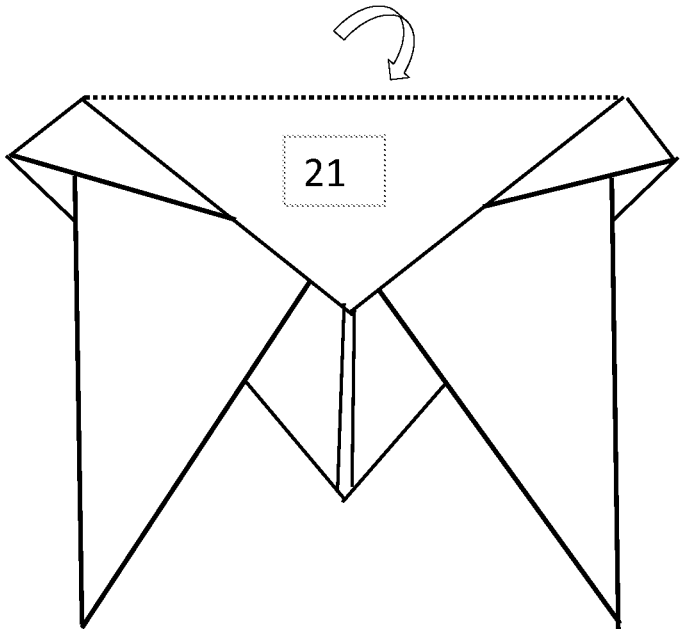
FIG. 12: depicts the top tip center of the fabric folded down and the arrow shows the direction of the fold. This fold will be centered and will complete the folds of Piece 21.

FIG. 12: illustrates the last fold which is the center tip folded down to form a triangle shape as seen by the dotted line as this illustration shows the completed portion of Piece 21. This fold will be centered and will complete the folds of Piece 21. The arrow indicates the direction of the fold.

Figure 13:
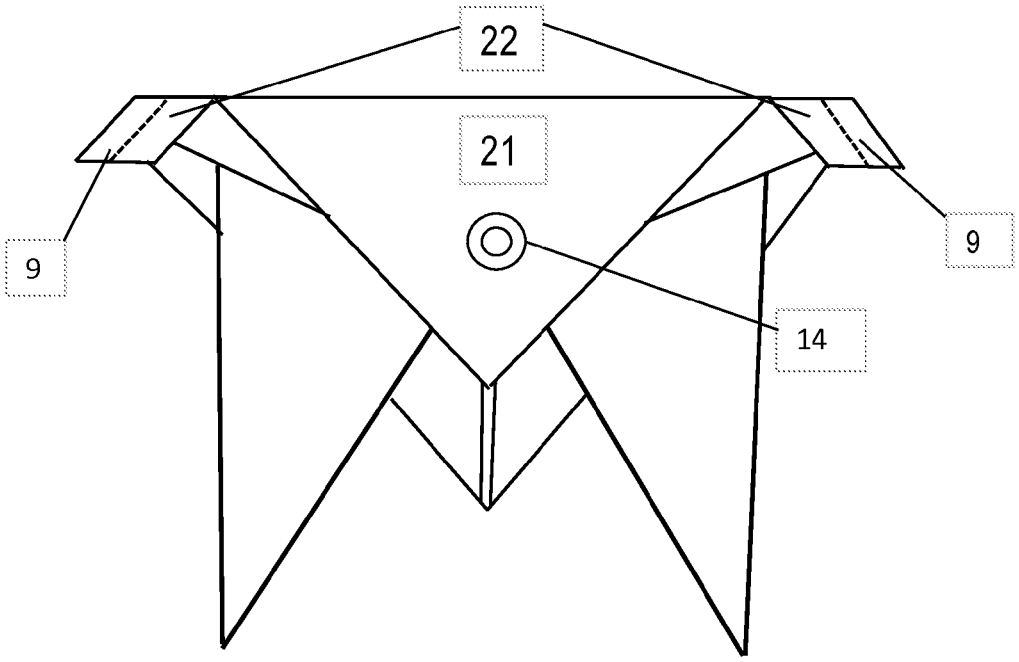
FIG. 13: depicts the front view of the combined attached Piece 21 and 22 that is either sewn, glued or the like 9 is the area with 1 to 3 magnets encased at the corners 14 is an added embellishment if desired.

FIG. 13: illustrates the front view of the combined Piece 21 and Piece 22, Piece 21 being the garment folded origami techniques and Piece 22, the rectangular band which is composed of a 7" W×1" H×⅛" D−/+¼" that is either sewn, glued or the like. Piece 22 encases neodymium magnet(s) at each end forming a pocket and is sewn or sealed shut by glue, or the like, so the magnet cannot escape the area 9. The magnets encased are neodymium of N42 or stronger 14 is an added embellishment if desired.

Figure 14:
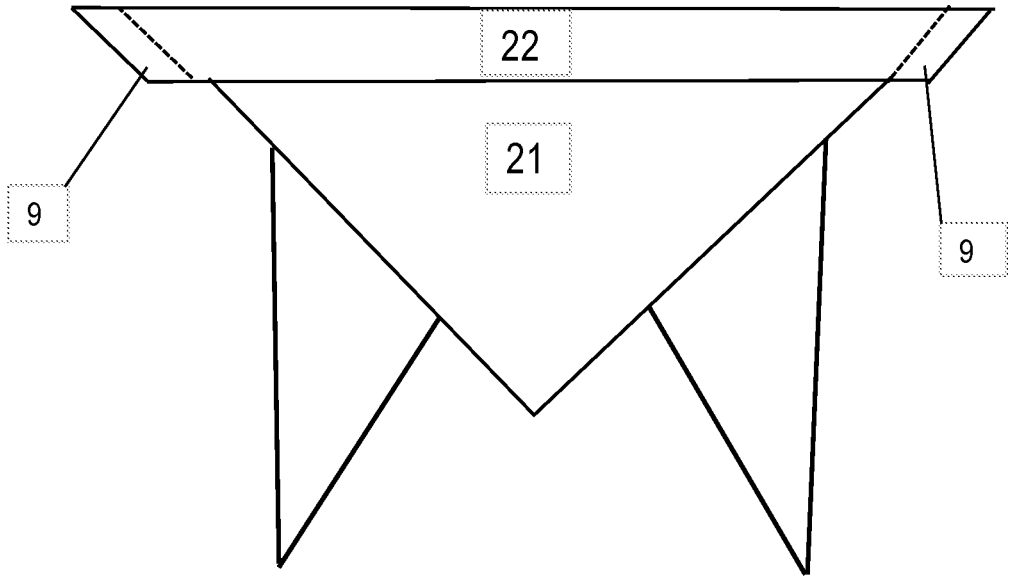
FIG. 14: depicts the back view of Pieces 21 and 22 bound together 9 show the magnetic corner pouches.

FIG. 14: illustrates the backside of Pieces 21 and 22. 9 show the magnetic corner pouches.

Figure 15:
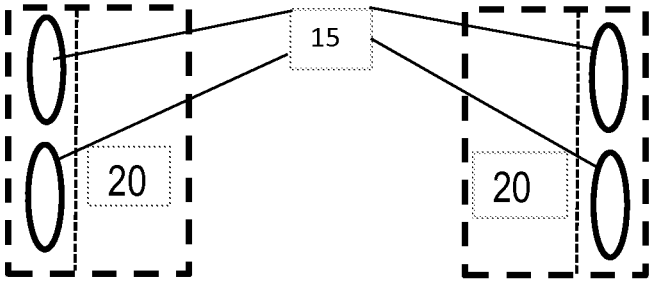
FIG. 15: depicts the encasement of magnets which are (2) two portions called Piece 20 which are shown by thick dashed lines that will contain 1 to 3 magnets each on average but not limited to that quantity. Piece 20, will be used underneath the collar area base inside the shirt collar base and not visible. 15 depicts the magnets encased in the pouches which is illustrated with the dashed line depicted were the sewn or sealed line would be located.

FIG. 15: illustrates the encasement of magnets which are (2) two portions called Piece 20 which are shown by thick dashed lines that will contain 1 to 3 magnets each on average but not limited to more than 3 magnets. These pouches are made of fabrics either natural or synthetic fibers. Place 20 will be inside the collar base area and not visible when attached. 15 illustrate the sealed portion with magnets encased so they cannot escape. The pouches or tabs are ¾" W×¾" H+/−¼" D. The separate tabs with magnets are utilized and necessary to complete the magnetic coupling to Piece 22.

Figure 16:
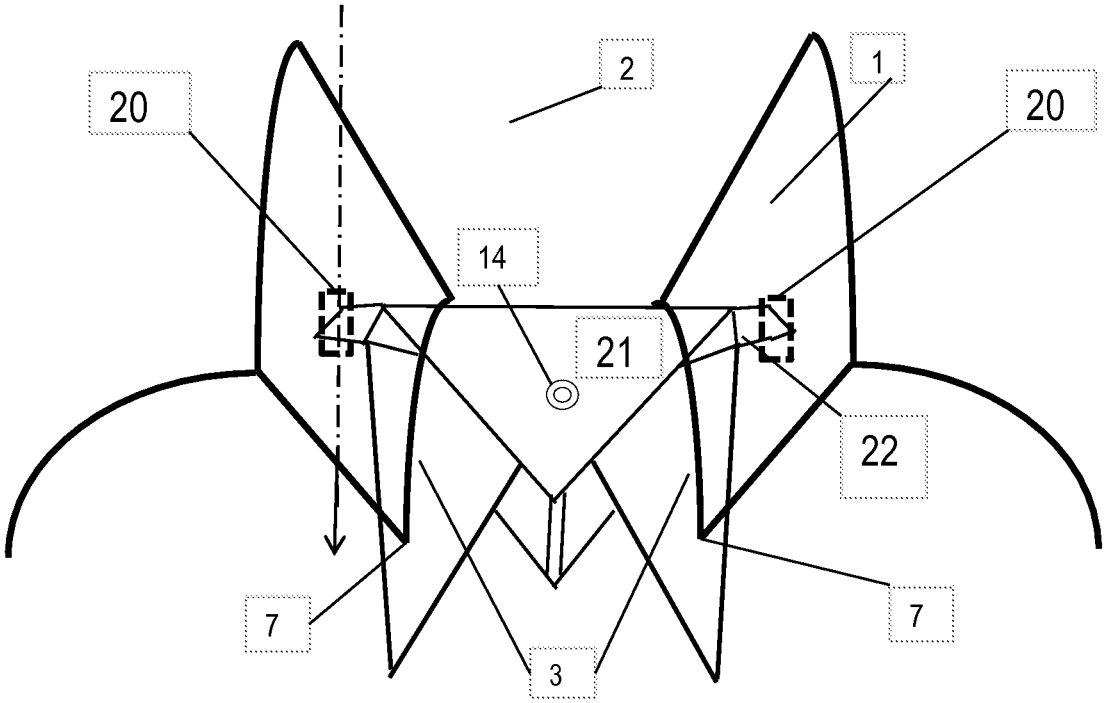
FIG. 16: depicts example of transparent view of a completed full origami folded invention to make the garment as seen under a collared shirt; attached together are Piece 20, Piece 21, Piece 22 and is magnetically connected and are complete. 1 is the collar shirt leaf 2 is the open area for the neck 3 is the collar spread opened and extended 7 is the collar leaf tips. The dashed dot arrow shows the section that will be depicted in FIG. 18 to show the coupling. 14 is the optional garment embellishment ornamental button or pin that can be used for fashion purposes.

FIG. 16: illustrates a transparent view of completed full origami folded pieces to make the garment as seen under a collared shirt that is unbuttoned. Attached together are Piece 20, Piece 21 and Piece 22 and the magnetic connection is completed. 1 illustrates the outside collar leaf of a typical shirt 2 illustrate the open area for the neck 3 is the collar spread which is extended since the top button is undone to allow air circulation 7 is the leaf collar point 14 is the optional garment embellishment ornamental button or pin for fashion purposes. The dashed dot arrow shows the section that will be depicted in FIG. 18 to show the coupling.

Figure 17:
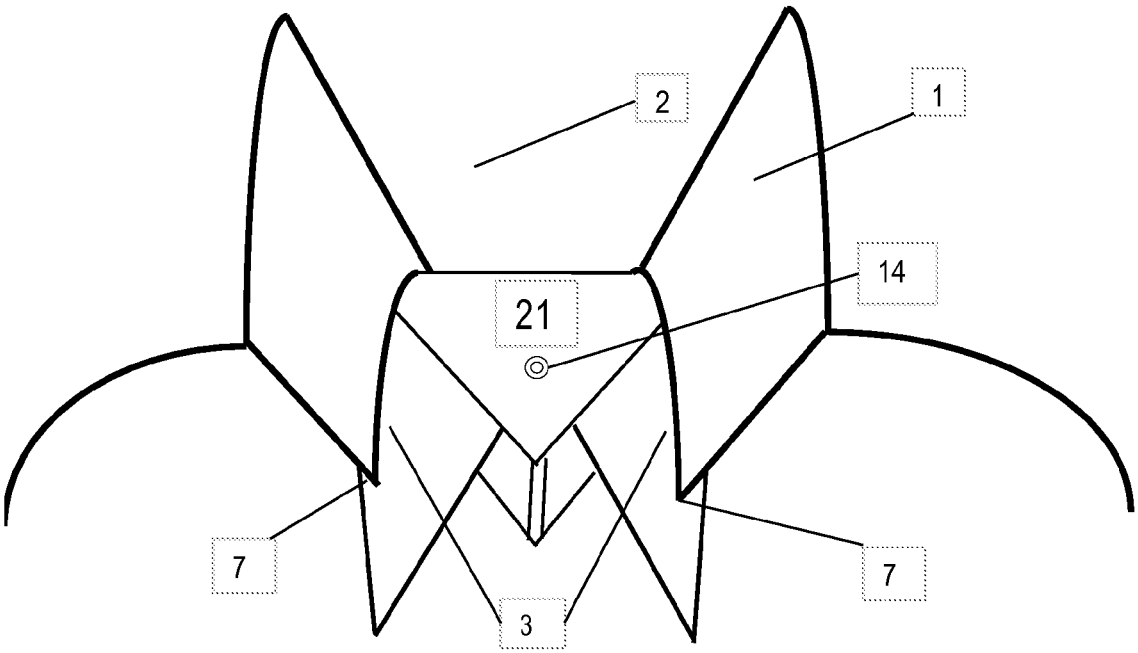
FIG. 17: illustrates a normal view of completed full origami folded pieces to make the garment as seen naturally. Attached together are Piece 20, Piece 21 and Piece 22. Piece 22 is only visible and the magnetic connection is completed. 1 is the collar leaf 2 is the neck area 3 is the collar spread opened and extended 7 are the leaf collar points 14 is the optional garment embellishment ornamental button or pin for fashion purposes.

FIG. 17: illustrates a normal view of completed full origami folded pieces to make the garment as seen naturally.

Attached together are Piece 20, Piece 21 and Piece 22 and the magnetic connection is completed. 1 illustrates the outside collar leaf of a typical shirt with a button closure at the neck area 2 illustrate the open area for the neck 3 is the increased collar spread area 7 is the leaf collar points 14 is the optional garment embellishment ornamental button or pin for fashion purposes.

Figure 18:
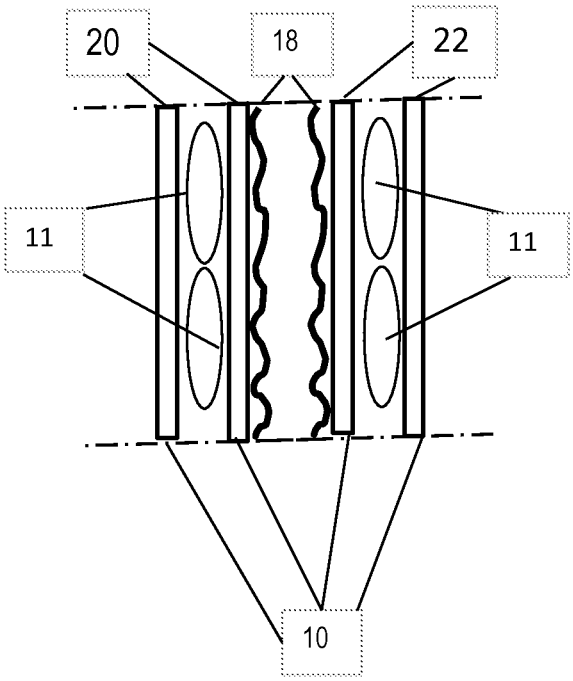
FIG. 18: depicts the section of the magnetic coupling. Piece 20, is the magnetic tab or pouches at the collar band, and Piece 22 is the end 9 area of the garment coupling. These two portions for illustrative purposes have (2) two magnets encased in each. 10 show the fabric 11 shows the magnets 18 show the collar base area of the shirt.

FIG. 18: depicts the section of the magnetic coupling Piece 20 to Piece 22. 18 is the collar band itself shown by double curved lines. These (2) two portions, for illustrative purposes, have two magnets encased in each and are not limited to only a quantity of (2) two. 10 shows the fabric 11 shows the magnets.

Figure 19:
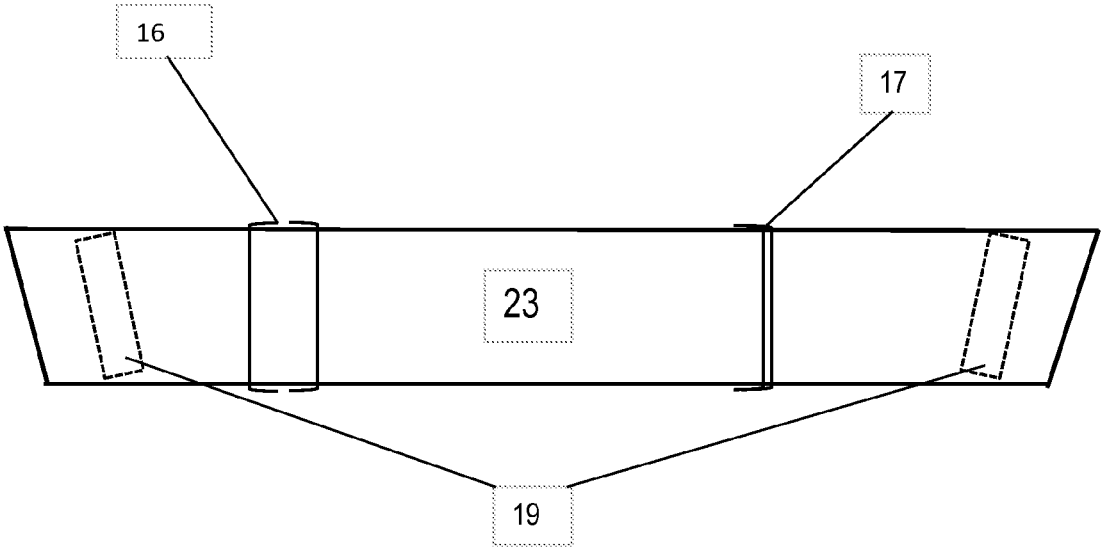
FIG. 19: depicts an alternate option for Piece 22, named Piece 23 which has adjustable strap with adjustable hardware mechanisms such as that would be seen in a typical bowtie strap or the like. Piece 23 contains a small hardware adjuster 16 hoop and 17 slider hardware. This Piece 23 will have 1 to 3 magnets at each end 19.

FIG. 19 illustrates an alternate option for Piece 22 which is an adjustable band such as seen in a typical bowtie strap, or the like, and contains small hardware adjusters 16 hoop and 17 slider mechanism. This Piece 23 will have 1 to 3 magnets at each end as does Piece 22, but is longer in dimension and can range from sizes 22" W×1" H×¾" D+/−½". This alternate strap will be adjustable for the wearers comfort if they desire to use this option rather than the frontal magnetic Piece 20 that would normally connect to Piece 21 at the outside under the collar leaf. For the purposes of the garment invention, the adjustable strap is not limited to having a standard commercial connection hook and loop at the ends to connect as would be seen in a typical bowtie in the market today. This invention of a new garment herewith in defines the integrity of the origami techniques and garment invention is well defined as said in Piece 21. If an adjustable strap in the market today is requested and attached to the origami folded technique of this invention, the wearer can request this attachment method at the time of creation. Piece 23 contains a small hardware adjuster 16 hoop and 17 slider hardware. This Piece 23 will have 1 to 3 magnets at each end 19.

Figure 20:
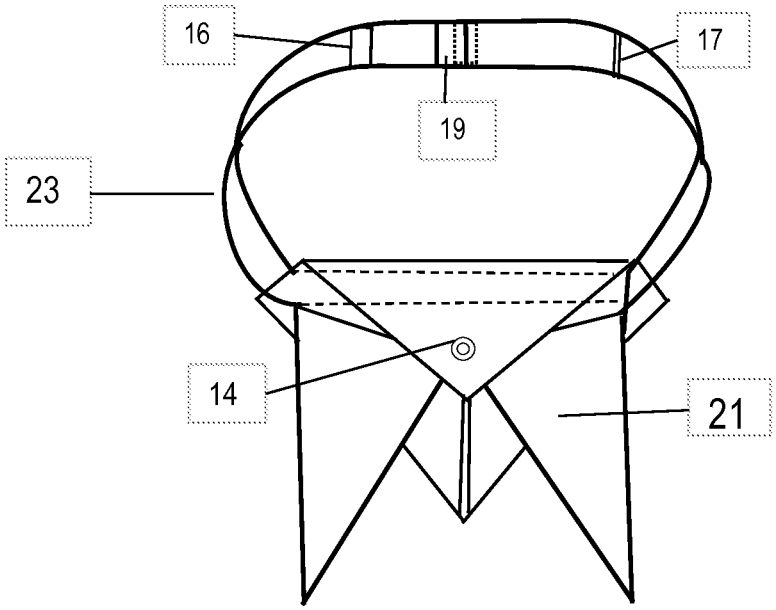
FIG. 20: Piece 21 and 23 as seen together. 14 is the optional garment embellishment ornamental button or pin for fashion purposes, hardware adjuster 16 hoop and 17 slider hardware and 19 are the magnetic ends connected together in the back.

FIG. 20: is the frontal view of the Piece 21 and 23 as seen together. Small hardware adjusters 16 hoop and 17 is the slider mechanism 14 is the optional garment embellishment ornamental button or pin for fashion purposes 19 shows the magnetic pouch areas The dashed lines depict the hidden area Piece 23 which is attached to Piece 21 that can be sewn, glued or the like. In some instances, Piece 23 may slide through or threaded, in a fold itself and not need to be attached or bound together but will be flexible for the wearer to adjust depending upon the origami technique.

Thus, there has been shown and described a novel garment and method with an apparatus of a magnetic technique for having a shirt wearer leave a top shirt unbuttoned and keep the neck area comfortable. It will be apparent for those familiar in the art of making garments, that modifications and variations and other uses and applications that do not depart from the spirit or the scope of the invention are deemed to be covered by the invention which is limited only by the claims cited.

What is claimed is:

1. A method of providing a folded origami neckwear accessory attached to a shirt collar, the method steps consisting of:

providing a shirt having collar, the collar including a collar base portion and a folded collar leaf portion; the collar terminating at a left and a right side which defines a collar span area;

providing magnetic pouch holding areas on the left and right side of the collar for holding magnetic pouches inside the shirt collar base; on each side of the collar, placing pouches filled with magnetic material inside the collar base at the left and right side magnetic pouch holding areas;

forming the origami neckwear accessory by providing two identical fabrics; binding the two identical fabrics about their perimeter to form a double layered fabric portion; turning the double layered fabric portion inside out and pressing the fabric portion; folding the double layered fabric in half to make to a first triangular shape; folding the first triangle shape to make a second smaller triangular shape; folding a top right corner of the second smaller triangle down with its tip folded to a bottom on a center line of the second triangle; folding a top left corner of the second smaller triangle down with its tip folded to the bottom on the center line to form the fabric portion into a diamond shape; folding the left and right corners of the diamond shape down; folding the top center of the diamond shape down to form a final neckwear accessory shape;

attaching additional fabric pieces containing magnets to a left outermost side and a right outermost side of the neckwear accessory;

positioning the garment accessory piece under the collar leaf with a thumb and forefinger and attaching the left and right side of the collar to the corresponding left and right side of the neckwear accessory using the magnets.

* * * * *